US009909456B2

(12) United States Patent
Richner et al.

(10) Patent No.: US 9,909,456 B2
(45) Date of Patent: Mar. 6, 2018

(54) NOZZLE RING

(71) Applicant: ABB Turbo Systems AG, Baden (CH)

(72) Inventors: Matthias Richner, Wettingen (CH); Josef Bättig, Egliswil (CH)

(73) Assignee: ABB Turbo Systems AG, Baden (CH)

( * ) Notice: Subject to any disclaimer, the term of this patent is extended or adjusted under 35 U.S.C. 154(b) by 564 days.

(21) Appl. No.: 14/083,025

(22) Filed: Nov. 18, 2013

(65) Prior Publication Data

US 2014/0140834 A1 May 22, 2014

(30) Foreign Application Priority Data

Nov. 16, 2012 (EP) ..... 12193018

(51) Int. Cl.

| | |
|---|---|
| ***F04B 17/00*** | (2006.01) |
| ***F01D 25/24*** | (2006.01) |
| ***F01D 9/04*** | (2006.01) |
| ***F01D 17/16*** | (2006.01) |

(52) U.S. Cl.

CPC ..... *F01D 25/246* (2013.01); *F01D 9/042* (2013.01); *F01D 17/165* (2013.01); *Y10T 29/49316* (2015.01)

(58) Field of Classification Search

CPC ..... F01D 17/00; F01D 17/14; F01D 17/165; F01D 9/02; F01D 9/042; F01D 9/048; F01D 1/08; F01D 25/246; F02C 6/12; Y10T 29/49316; F02B 37/18; F02B 37/186

See application file for complete search history.

(56) References Cited

U.S. PATENT DOCUMENTS

| | | | | |
|---|---|---|---|---|
| 3,495,921 | A | 2/1970 | Swearingen | |
| 4,502,836 | A | 3/1985 | Swearingen | |
| 5,182,855 | A | 2/1993 | Martin | |
| 5,586,864 | A * | 12/1996 | Knorowski | F01D 9/044 415/209.2 |
| 5,964,574 | A * | 10/1999 | Meier | F01D 9/045 415/110 |
| 6,729,134 | B2 * | 5/2004 | Arnold | F01D 5/141 415/144 |
| 8,047,771 | B2 * | 11/2011 | Tucker | B23K 1/0018 415/137 |
| 2002/0094284 | A1 | 7/2002 | Arnold | |
| 2002/0187061 | A1 | 12/2002 | Arnold | |

FOREIGN PATENT DOCUMENTS

| | | | |
|---|---|---|---|
| DE | 102012001236 | A1 | 7/2013 |
| GB | 731822 | | 6/1955 |
| JP | 2002332857 | A | 11/2002 |
| JP | 2002332862 | A | 11/2002 |

(Continued)

OTHER PUBLICATIONS

Search Report dated Jun. 18, 2013, by the European Patent Office for Application No. 12193018.4.

*Primary Examiner* — Woody Lee, Jr.
*Assistant Examiner* — Maxime Adjagbe
(74) *Attorney, Agent, or Firm* — Barnes & Thornburg LLP

(57) ABSTRACT

An exemplary nozzle ring has two fastening rings and a plurality of guide vanes, wherein holes are provided in one of the fastening rings for accommodating pins of the guide vanes, and openings are provided in the other fastening ring for accommodating positioning aids on the guide vanes.

20 Claims, 6 Drawing Sheets

(56) References Cited

FOREIGN PATENT DOCUMENTS

| | | | |
|---|---|---|---|
| JP | 2003184563 | A | 7/2003 |
| JP | 2011231740 | A | 11/2011 |
| WO | WO 01/69045 | A1 | 9/2001 |
| WO | 2005031120 | A1 | 4/2005 |
| WO | 2008133320 | A1 | 7/2010 |

* cited by examiner

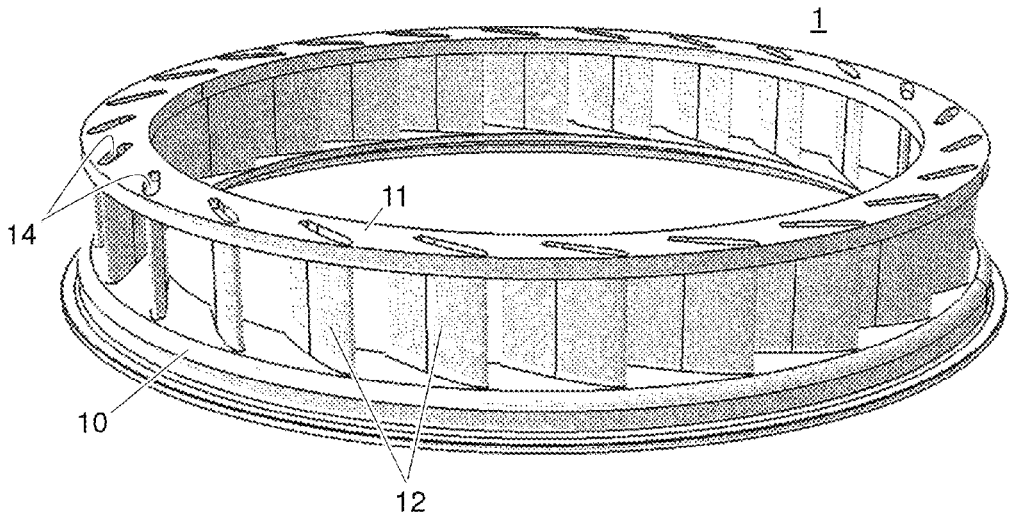
Fig. 3
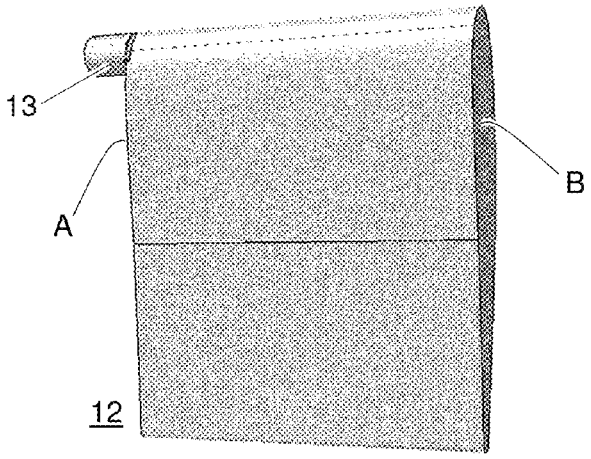
Fig. 4
Fig. 5
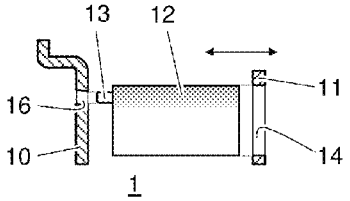

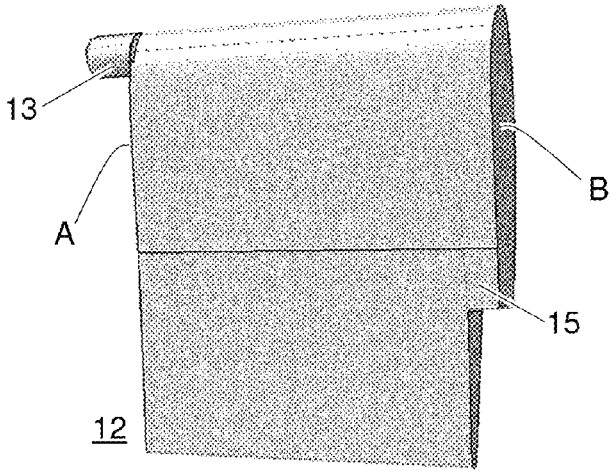
Fig. 6
Fig. 7
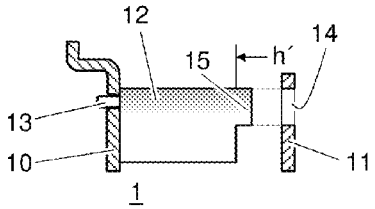
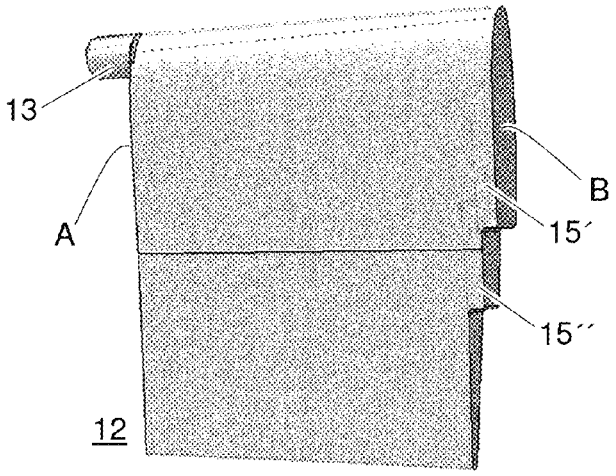
Fig. 8
Fig. 9
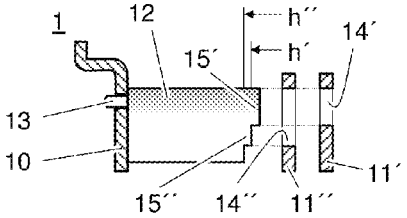

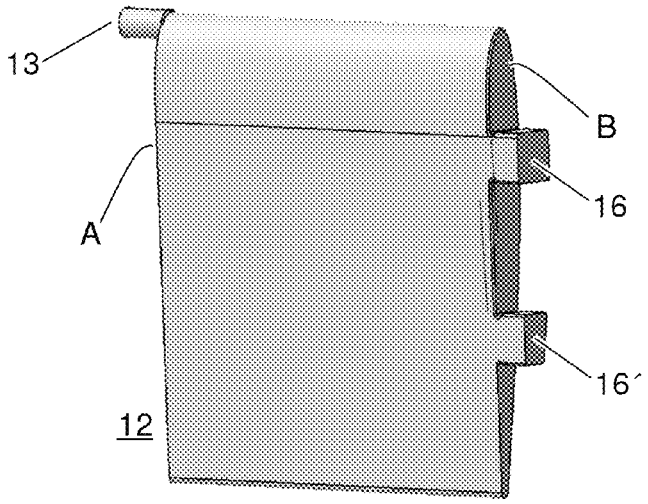
Fig. 10
Fig. 11
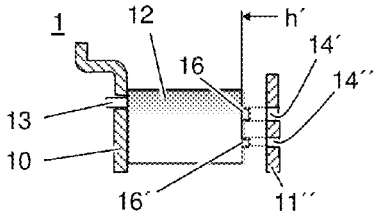
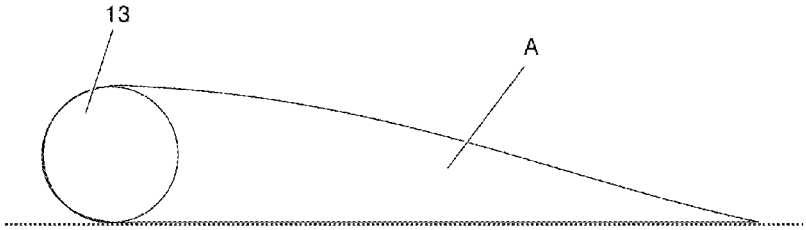
Fig. 12a
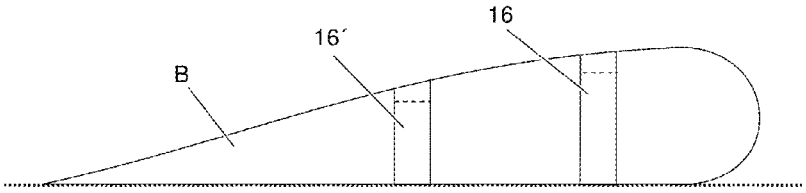
Fig. 12b

NOZZLE RING

RELATED APPLICATION(S)

This application claims priority under 35 U.S.C. § 119 to European application 12193018.4 filed in Europe on Nov. 16, 2012, the content of which is hereby incorporated by reference in its entirety.

FIELD

The disclosure relates to the field of turbomachines, such as exhaust gas turbochargers for charged internal combustion engines, and a nozzle ring for such a turbomachine.

BACKGROUND INFORMATION

Known turbochargers are used for power augmentation of reciprocating piston engines. So that the turbine can be operated as efficiently as possible, the exhaust gas is deflected in front of the turbine in a row of guide vanes of a guide vane device, also called a nozzle ring. In exhaust gas turbochargers with radial turbines, the nozzle ring includes (e.g., comprises) two fastening rings, which delimit the flow passage on both sides, and a plurality of guide vanes, which, depending upon application, are at a specified angle in relation to the flow and also have a different length.

FIG. 13 shows a schematic sectional view of a known exhaust gas turbocharger with radial turbine having a nozzle ring on the turbine side in accordance with the state of the art. As shown in FIG. 13, the exhaust gas turbocharger has a radial-inflow exhaust gas turbine and a radial compressor 2. So that the exhaust gas turbine can be operated as efficiently as possible, the exhaust gas, before reaching the turbine wheel 3, is directed in a guide vane device, this being the nozzle ring 1, onto the rotor blades 31 of the turbine wheel 3.

If the nozzle ring 1 is produced in one piece by means of sand or investment casting processes, the flow guiding is as a rule certainly very good, for which a separate casting pattern has to be manufactured for each blade angular position. Moreover, the flexibility for additional angular positions or guide vane spacing's is limited since with each change a new casting pattern has to be produced, which both becomes expensive and results in a very long lead time.

In addition, there is a known method in which guide vanes are welded or soldered in individual rings. In this method, the flow guiding is optimum, but new rings should be provided for each angular position, for which the costs are a little less than in the case of the investment casting process.

In the most cost effective production variants of those which are widely applied, plates are welded or soldered between the fastening rings instead of prismatic profiles. The formed guide vanes are arranged in recesses in the fastening rings and welded or soldered therein. In the case of such nozzle rings, the flow guiding is considerably poorer than in the case of the two first-named variants on account of the plate profiles. Moreover, the walls are extremely thin in such nozzle rings and therefore susceptible to erosion as a result of exhaust gas particles.

Therefore, when nozzle rings are being produced a compromise between costs and efficiency of the nozzle ring should be adopted. To date, there has been no production method which is noticeably more cost effective than the investment casting process and still achieves a comparable, excellent flow guiding.

One known solution involves the assembly of nozzle rings from two fastening rings and from a multiplicity (e.g., plurality) of vanes of identical construction, as a result of which flexibility in production is significantly improved. So that assembled nozzle rings can cover the main functions of vane position and vane length (spacing's of the two fastening rings), but also include additional functions such as fastening of the entire nozzle ring in the turbocharger or sealing against leakage flow, different, or at least differently finished, base components are often used.

SUMMARY

An exemplary nozzle ring is disclosed, comprising: a first, annular plate-like fastening ring; a second, annular plate-like fastening ring; and a plurality of guide vanes which are arranged between the first and second fastening rings and are fixed in a respective angular position, wherein the first and second fastening rings are arranged coaxially to each other, wherein the guide vanes have in each case a pin on a first end face, such that the guide vanes are configured to be guided in a first fastening ring through an arrangement of a respective pin in a respective hole, wherein the respective pin and the respective hole are configured such that, during assembly of the nozzle ring, the guide vanes are oriented in respective angular positions, wherein on a second end face, the guide vanes, have in each case at least one positioning aid which corresponds at least partially to an outer contour of said second end face, and wherein the guide vanes are fixed with regard to their angular position through an arrangement of the at least one positioning aid in an opening, which in each case corresponds to a shape of the positioning aid in the second fastening ring.

A guide vane for arranging and fixing in a respective angular position between two fastening rings of a nozzle ring is disclosed, wherein the two fastening rings are arranged coaxially to each other; wherein the guide vane has a pin on a first end face; and wherein, on a second end face, the guide vane has at least one positioning aid which in each case corresponds at least partially to an outer contour of the second end face.

A method for producing a nozzle ring with a plurality of guide vanes which are arranged between a first fastening ring and a second fastening ring is disclosed, the method comprising: providing, on one end face of the guide vanes, pins for arranging each guide vane in holes of the first fastening ring; providing openings in the second fastening ring, which openings correspond to a shape of positioning aids of the guide vanes, and into which the positioning aids of the guide vanes are inserted; and providing the guide vanes to the two fastening rings in a materially bonding, frictionally locking, or form-fitting manner.

BRIEF DESCRIPTION OF THE DRAWINGS

Exemplary embodiments of the nozzle ring according to the disclosure are described in the following with reference to the drawings. In this case, in the drawings

FIG. 3 shows an isometric view of a second nozzle ring having a plurality of guide vanes in accordance with an exemplary embodiment of the present disclosure;

FIG. 4 shows a detailed view of a guide vane of the first nozzle ring shown in FIG. 2 in accordance with an exemplary embodiment of the present disclosure;

FIG. 5 shows a schematic sectional view of the nozzle ring shown in FIG. 2 in accordance with an exemplary embodiment of the present disclosure;

FIG. 6 shows a detailed view of a guide vane of the second nozzle ring shown in FIG. 3 in accordance with an exemplary embodiment of the present disclosure;

FIG. 7 shows a schematic sectional view of the second nozzle ring shown in FIG. 3 in accordance with an exemplary embodiment of the present disclosure;

FIG. 8 shows a detailed view of a guide vane of a third nozzle ring in accordance with an exemplary embodiment of the present disclosure;

FIG. 9 shows a schematic sectional view of a third nozzle ring in accordance with an exemplary embodiment of the present disclosure;

FIG. 10 shows a detailed view of a guide vane of a fourth nozzle ring in accordance with an exemplary embodiment of the present disclosure.

FIG. 11 shows a schematic sectional view of a fourth nozzle ring in accordance with an exemplary embodiment of the present disclosure;

FIG. 12*a*, and 12*b* show a detailed view of guide vane tips in accordance with an exemplary embodiment of the present disclosure;

DETAILED DESCRIPTION

Figure 1:
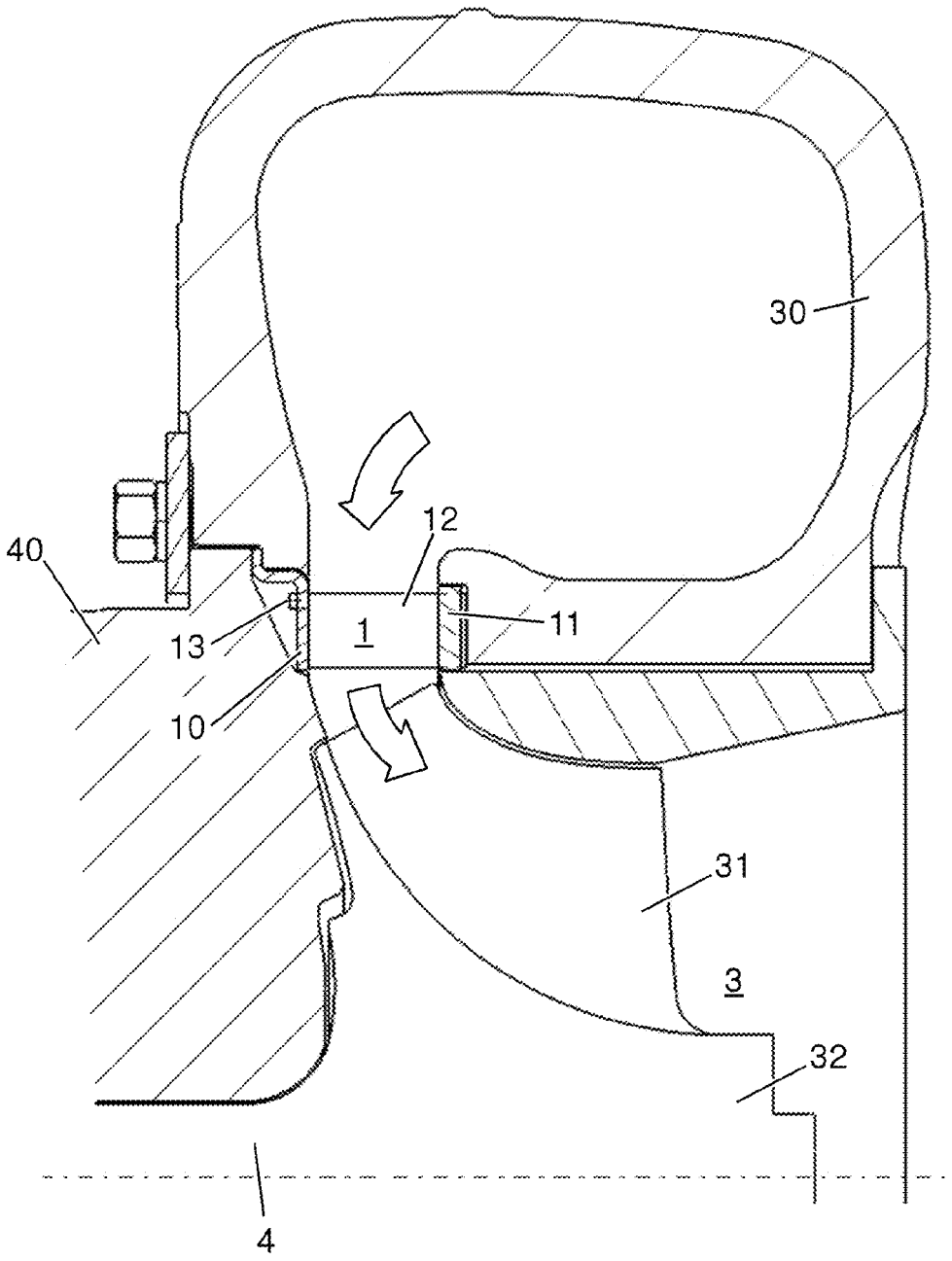
FIG. 1 shows a sectional view of a radial turbine of an exhaust gas turbocharger with a nozzle ring in accordance with an exemplary embodiment of the present disclosure.
Figure 13:
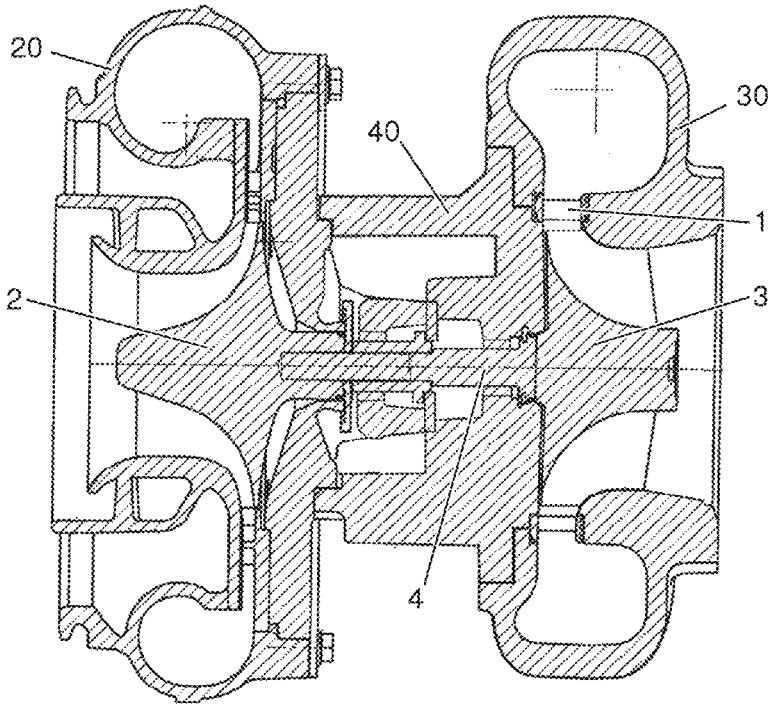
Fig. 13 (prior art)
FIG. 13 shows a schematic sectional view of a known exhaust gas turbocharger with a radial turbine having a nozzle ring on the turbine side in accordance with the state of the art.

Exemplary embodiments of the present disclosure create an assembled nozzle ring with the flow guiding of a nozzle ring which is produced in the investment casting process, and which can be assembled from few individual elements in a modular manner for different vane positions and vane lengths.

According to exemplary embodiments of the present disclosure, a nozzle ring can include guide vanes having a pin on one end face which is accommodated in a hole, which is provided for the pin, in a first fastening ring. At the other end, the angular position of the vanes is set in the second fastening ring by means of a corresponding profiled recess in the fastening ring, which corresponds either to the complete surface of the end face or only to the profile of the projections on the end face, and is permanently fixed as a result of the installation of the vanes.

The pins on the first end face have the advantage that the first fastening ring specifies only simple holes for accommodating the vanes. Consequently, this fastening ring can also have more complex shapes without the production of this ring becoming more difficult as a result of profiled cutouts. For all vane angular positions, only one ring with always the same holes at the pivot point of the vanes can be used.

The passage width, and therefore the effective blade length which has an effect in the flow passage, is set by means of the second fastening ring with the profiled cutouts. Adjustment can be carried out via a shoulder, or via a plurality of shoulders, on the guide vanes or by means of a spacing tool during the joining of the contact points.

The pivot point of the individual guide vanes, depending upon embodiment, can vary, therefore the pin, depending upon embodiment, can be arranged at different places along the end face of the guide vane.

The guide vanes of the nozzle ring can be produced with a variable profile (e.g., shape, cross section and angular position) in the investment casting process, powder-metallurgical process or precision forging process.

For fastening the guide vanes on the fastening rings, these can be interconnected in a materially bonding manner, for example by means of welding or soldering. In each case, these are interconnected in such a way that the guide vanes and fastening rings are immovable in relation to each other after assembly. Optionally, the guide vanes can also be fastened on the fastening rings in a form-fitting or frictionally locking manner, for example by means of a snap-in device or by means of a pressed joint.

If the individual guide vanes are produced in the investment casting process, they can have any desired geometry, as a result of which optimum flow guiding is created in the finished assembled nozzle ring, corresponding to the flow guiding of the nozzle ring which is produced in one piece in the investment casting process.

The guide vanes can advantageously be cast as hollow profiles, as a result of which the overall weight of the nozzle ring can be reduced. This becomes lighter as a result and is therefore simpler to install and remove. Also, as a result of the hollow profiles of the guide vanes the transient stresses during operation with hot air flows are positively influenced.

According to an exemplary embodiment of the present disclosure the nozzle ring, which is assembled from individual parts, can be significantly more cost effective to produce than a comparable one-piece nozzle ring which is produced in the investment casting process. Cost advantages result from the casting or forging operation which is simplified many times over. The additional cost as a result of providing and prefabricating the fastening rings is further reduced by the first fastening ring with holes for accommodating the pins being able to be used for a plurality of exemplary embodiments of nozzle rings with different angular positions.

Since the exemplary nozzle ring of the present disclosure is assembled from different individual parts, different materials can also be used. This contributes further to the lowering of the production costs in relation to a nozzle ring which is produced in one piece in the investment casting process. Thus, for example only the guide vanes can be cast or forged from a higher value material (for example a nickel-based alloy), whereas the fastening rings can be produced from an inexpensive material (for example CrNi steel). Naturally, the two fastening rings can also be produced from another material in each case since they have to withstand different thermal or mechanical loads, for example.

A further advantage of the exemplary embodiments of the present disclosure in which the nozzle ring can be produced from individual guide vanes and separate fastening rings is the realization of nozzle rings with different vane positions and a single vane profile. For producing the fastening rings, only a marginally more appreciable additional cost is incurred in this case since only the pattern or the program for cutting out the openings in the fastening ring has to be changed. In contrast, in the case of the nozzle ring which is produced in one piece in the investment casting process a separate casting pattern, which can be specially manufactured, is specified for each vane position. In the case of an exhaust gas turbocharger of a specific overall size, for example, up to 10 different staggers (angular position of the profiles) become necessary.

Exemplary embodiments of the present disclosure provide a further advantage of the nozzle ring in which individual segments, instead of a complete nozzle ring, can be produced without noticeable additional cost. A nozzle ring which is divided into two or more segments in the circumferential direction has a better transient behavior during heating up and cooling down. Moreover, the individual parts of the segmented nozzle ring, even without hollow profiles, can be markedly lighter than a complete, one-piece nozzle ring, which is advantageous for installation and removal.

So that the nozzle ring according to the disclosure can be positioned correctly and permanently with regard to the circumferential direction when being installed in the turbomachine, positioning elements can be provided on the fastening rings. These can be formed as projections or as grooves which are let into the fastening rings.

The exemplary embodiments of the nozzle ring according to the present disclosure are described with regard to use in a radial turbine of an exhaust gas turbocharger. The exemplary nozzle rings according to the disclosure can be suitable, however, for other turbomachines, such as for pumps, compressors, gas turbines, or other machines as desired.

FIG. 1 shows a sectional view of a radial turbine of an exhaust gas turbocharger with a nozzle ring in accordance with an exemplary embodiment of the present disclosure. The flow direction of the exhaust gas flow coming from the combustion chambers of the reciprocating piston engine is indicated by the arrows. The nozzle ring 1 which is designed according to the disclosure can be assembled from a multiplicity (e.g., plurality) of guide vanes 12 which are arranged in the flow passage in a regularly or irregularly distributed manner in the circumferential direction. The guide vanes 12 can be retained in a fixed angular position on both sides of the flow passage in each case by an annular plate-like fastening ring 10 and 11. On the side facing the bearing housing 40, the guide vanes 12 can be positioned in a hole in the fastening ring 10 by means of a pin 13. On the side facing away from the bearing housing 40, the guide vanes 12, include positioning aids. The arrangement of the positioning aids in the respective openings in the second fastening ring 11, which correspond to the shape of the respective positioning aid, fixes the guide vanes 12 with regard to their angular position. The way in which the nozzle ring—which is assembled from individual parts in a modular manner—is explained with reference to the further figures.

Figure 2:
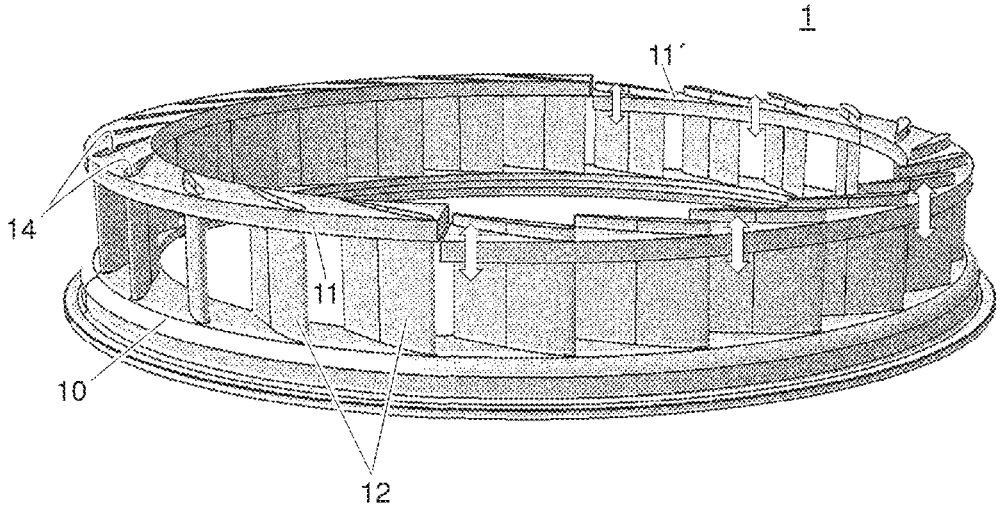
FIG. 2 shows an isometric view of a first nozzle ring having a plurality of guide vanes in accordance with an exemplary embodiment of the present disclosure.

FIG. 2 shows an isometric view of a first nozzle ring having a plurality of guide vanes in accordance with an exemplary embodiment of the present disclosure; and FIG. 3 shows an isometric view of a second nozzle ring having a plurality of guide vanes in accordance with an exemplary embodiment of the present disclosure. FIG. 2 and FIG. 3 show in each case isometric views of a finished assembled nozzle ring 1, which is designed according to the disclosure, but not yet installed in a turbomachine. As shown, the nozzle ring 1 has a plurality of individual guide vanes 12 which are arranged in a distributed manner in the circumferential direction between the first fastening ring 10 and the second fastening ring 11 and fixed in their angular position, wherein the two fastening rings are arranged parallel to each other and coaxially with regard to their common central axis.

An annular plate, this being the first fastening ring 10, serves as a base of the nozzle ring 1. Depending upon the installation geometry in the exhaust gas turbine, the first fastening ring 10 can assume shapes which go beyond the plate-like basic shape, for example an additional fastening flange, in order to enable the fastening in the connection between bearing housing 40 and turbine housing 30. Regarding functionality, only the annular plate shape is of importance, however, for the first fastening ring. Holes, in which pins of the guide vanes of the nozzle ring can subsequently be accommodated and, if necessary, be fixed, are let into the annular plate of the first fastening ring 10, which during operation also delimits the flow passage.

FIG. 4 shows a detailed view of a guide vane of the first nozzle ring shown in FIG. 2 in accordance with an exemplary embodiment of the present disclosure; and FIG. 5 shows a schematic sectional view of the nozzle ring shown in FIG. 2 in accordance with an exemplary embodiment of the present disclosure. The guide vanes 12, in the exemplary embodiment shown in FIGS. 2, 4 and 5, includes a blade body of streamlined design with two planar end faces A and B, and also a pin 13 which is arranged on the end face A of the guide vane which faces the first fastening ring. In this case, the end faces B serve as positioning aids in order to fix the guide vanes 12 in the predetermined angular position. The pin 13 is matched by length, diameter and its shape to the holes 16 in the first fastening ring 10 so that the guide vanes 12 in the inserted state, before a possible, final fixing, can be oriented into the angular position which is predetermined by the opening in the second fastening ring, for example, by rotating the guide vanes around the axis of the pin. Optionally, the rotation of the guide vanes around the axis of the pin can be limited to one angular range, or to a plurality of angular ranges, or to individual discrete angular values on account of the shape of the hole and the pin and does not necessarily have to allow a complete, continuous rotation of the pin in the hole.

The third element of an exemplary nozzle ring is constructed modularly according to the present disclosure is the second fastening ring 11 which in the simplest form is only a thin plate with openings 14 for accommodating the positioning aids of the guide vanes 12. In this case, the openings 14 are matched in size and shape to the shape of the positioning aids and correspond to the contour of the positioning aids which are to be accommodated in the openings 14. The positioning aids correspond in this case at least partially to the profile of the end face B so that the openings 14 correspond either partially or completely to the contour of the end face B of the guide vanes 12. As a result of the orientation of the openings 14, the position of the individual guide vanes is fixed. Each guide vane can be rotated in the hole 16 in the first fastening ring 10 around the axis of the pin until the intended position is fixed by pushing in the free end of the guide vane into the opening 14 in the second fastening ring 11. In order to be able to produce nozzle rings with differently oriented guide vanes 12, according to the disclosure only the second fastening ring 11 should be adapted, whereas the first fastening ring 10 and the guide vanes 12 can remain unaltered for all possible angles of the guide vanes 12.

The recesses in the second fastening ring are advantageously cut out or stamped out during the production. In the case of cutting, laser cutting can be suitable. Alternatively, both fastening rings can be cast as individual parts.

According to an exemplary embodiment of the present disclosure, the second fastening ring of the nozzle ring can have openings 14 which correspond to the complete guide vane cross-section profile since the end faces B altogether serve as positioning aids. As a result, the second fastening ring 11 can be displaced along the height of the guide vanes, as is indicated in the right-hand half of FIG. 2 with the second fastening ring split for the purpose of illustration. Therefore, with an invariably formed fastening ring nozzle rings of different flow-passage width can be produced.

FIG. 6 shows a detailed view of a guide vane of the second nozzle ring shown in FIG. 3 in accordance with an exemplary embodiment of the present disclosure; FIG. 7 shows a schematic sectional view of the second nozzle ring shown in FIG. 3 in accordance with an exemplary embodiment of the present disclosure; and FIG. 8 shows a detailed view of a guide vane of a third nozzle ring in accordance with an exemplary embodiment of the present disclosure. In the exemplary embodiments shown to FIG. 3 and also to FIGS. 6 to 8, the openings 14 in the second fastening ring 11 are formed so that they no longer correspond to the complete guide vane cross-section profile but can only accommodate a part of the guide vane tip in the region of the end face B.

The positioning aids can be constructed such that they correspond only partially to the profile of the end face B. The guide vane tips, according to the exemplary embodiment of FIGS. 6 and 7, are provided with a projection 15, the outer contour of which corresponds in shape and size to the opening 14 in the second fastening ring 11. As shown in FIG. 7, the second fastening ring 11 of the exemplary embodiment is displaced along the height of the guide vane. Rather, a stop on the guide vane ensures a defined height h' of the flow passage in the nozzle ring 1.

FIG. 9 shows a schematic sectional view of a third nozzle ring in accordance with an exemplary embodiment of the present disclosure. The guide vane tips according to the exemplary embodiment shown in FIGS. 8 and 9 have two projections 15' and 15" formed in a stepped manner, which with one type of guide vane and two differently formed second fastening rings 11' and 11" allow two different, specified flow passage heights h' and h" to be realized. For this, in the respective second fastening rings the openings 14' and 14" are matched to the outer contour of the respective projections 15' or 15" on the guide vanes.

FIG. 11 shows a schematic sectional view of a fourth nozzle ring in accordance with an exemplary embodiment of the present disclosure; and FIG. 12*a*, and 12*b* show a detailed view of guide vane tips in accordance with an exemplary embodiment of the present disclosure. In the exemplary embodiment shown in FIGS. 10 to 12, the guide vane tips are designed such that they include two positioning aids. To this end, the guide vane tips have two separately formed projections 16 and 16'. This allows a larger tolerance during production of the individual guide vanes 12 since as a result of two positioning aids improved accuracy in positioning during assembly can be achieved. The respective second fastening rings 11" are designed in such a way that the projections 16 and 16' of the guide vane tips are accommodated in separate openings 14' and 14". In this case, the openings 14' and 14" correspond in shape and size to the contour of the projections 16 and 16'. FIG. 12 shows a plan view of the two end faces A and B. According to the disclosure, the projections 16 and 16' have a common contour with the end face B of the guide vanes 12 in the lower region. By means of the dashed line in the upper region, it is to illustrate that the projections 16 and 16' in the upper region do not necessarily have to correspond to the contour of the end face B of the guide vanes 12.

Figure 15:
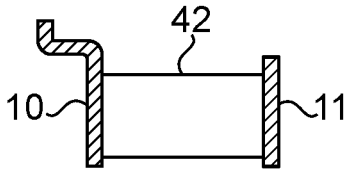
FIG. 15 shows a schematic sectional view of the nozzle ring with a spacer.

During the assembly of the nozzle ring, which according to the disclosure is assembled in a modular manner, the guide vanes are inserted by their pins into the holes of the first fastening ring, as described above. On the opposite side, the free ends of the guide vanes are introduced into the matching openings in the second fastening ring, wherein the guide vanes are oriented around the axes of the pins in the holes so that the positioning aids are accommodated in the openings in the second fastening ring. Alternatively, the guide vanes can first be inserted into the second fastening ring and then the pins can be guided into the holes of the first fastening ring. If the flow passage height of the nozzle ring is not fixed via a stop, as in the exemplary embodiments according to FIGS. 6 to 12, the desired flow passage height can be set by means of spacers 42 which are arranged between the two fastening rings as shown in FIG. 15. Finally, the components are interconnected in a materially bonding manner, for example by means of welding or soldering, as a result of which these are immovably connected to each other, forming a single component. Optionally, the components can also be interconnected in a form-fitting or frictionally locking manner, for example by means of a snap-in device or a pressed joint.

Figure 14A:
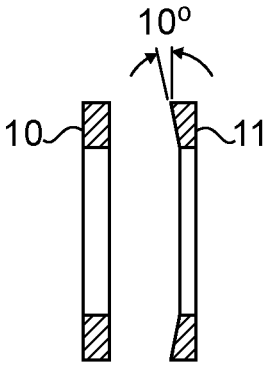
FIG. 14*a*, and 14*b* shows sectional views of the first and second fastening rings in accordance with exemplary embodiments of the present disclosure.
Figure 14B:
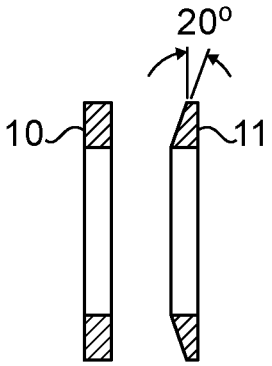

Although in the represented exemplary embodiments the two fastening rings are arranged parallel to each other in each case, exemplary embodiments are also conceivable and protected by the subsequent claims in which the fastening rings are arranged at an angle to each other. In this case, as shown in FIG. 14*a*-14*b*, the first fastening ring and/or the second fastening ring are/is, of a conical design in each case so that between the coaxially arranged fastening rings, in the section taken along the axis, an angular position which deviates from the parallel arrangement is created. In this case, angular openings within the range of −10° (narrowing radially outward) (FIG. 14*a*) to +20° (opening radially outward) (FIG. 14*b*) are conceivable. For illustration purposes, the guide vanes 12 have been omitted from FIG. 14*a*-14*b*.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

1 Nozzle ring
10, 11 Fastening ring
12 Guide vane
13 Pin
14 Opening in the fastening ring
15 Projection
16 Hole
2 Compressor impeller
20 Compressor casing
3 Turbine wheel
31 Rotor blades of the turbine wheel
32 Hub of the turbine wheel
30 Turbine housing
4 Shaft
40 Bearing housing
A, B End face of the guide vanes
42 Spacer

What is claimed is:

1. A nozzle ring, comprising:

a first, annular plate-like fastening ring;

a second, annular plate-like fastening ring; and a plurality of guide vanes which are arranged between the first and second fastening rings and are fixed in a respective angular position, wherein the first and second fastening rings are arranged coaxially and axially spaced apart from each other, wherein the guide vanes have in each case a pin on a first end face, such that the guide vanes are configured to be guided in the first fastening ring through an arrangement of a respective pin in a respective hole, wherein the respective pin and the respective hole are configured such that, during assembly of the nozzle ring, the guide vanes are oriented in respective angular positions, wherein on a second end face, the guide vanes, have in each case at least one positioning aid which corresponds at least partially to an outer contour of said second end face, and wherein the guide vanes have permanently fixed angular position by engagement of the at least one positioning aid in an opening in the second fastening ring, which in each case is matched in size and shape to the positioning aid and corresponds in contour to the positioning aid.

2. The nozzle ring as claimed in claim 1, wherein the hole in the first fastening ring and the pin of the guide vanes are formed such that rotation of the pin is limited to one angular range or to individual, discrete angular values.

3. The nozzle ring as claimed in claim 1, wherein the guide vanes are connected to at least one of the first and the second fastening ring in a form-fitting, frictionally locking, or materially bonding manner.

4. The nozzle ring as claimed in claim 1, wherein the positioning aids of the guide vanes are designed such that each second end faces has at least one projection that projects in relation to the end face, and wherein the guide vanes, along the at least one projection, are arranged in an opening corresponding to the outer contour of the at least one projection in the second fastening ring.

5. The nozzle ring as claimed in claim 1, wherein the guide vanes are produced from a first material, and wherein at least one of the first fastening ring and the second fastening ring is produced from a second material which is different from the first material.

6. The nozzle ring as claimed in claim 5, wherein the guide vanes are produced from a nickel-based alloy, and wherein at least one of the first fastening ring and the second fastening ring is produced from a CrNi steel.

7. The nozzle ring as claimed in claim 1, wherein at least one of the first fastening ring and the second fastening ring is a conical design such that an opening defined between the first and second fastening rings is tapered at an angle of between −10° and +20° proceeding radially outward.

8. The nozzle ring as claimed in claim 2, wherein the guide vanes are connected to at least one of the first and the second fastening ring in a form-fitting, frictionally locking, or materially bonding manner.

9. The nozzle ring as claimed in claim 2, wherein the positioning aids of the guide vanes are designed such that each second end faces has at least one projection that projects in relation to the end face, and wherein the guide vanes, along the at least one projection, are arranged in an opening corresponding to the outer contour of the at least one projection in the second fastening ring.

10. The nozzle ring as claimed in claim 2, wherein the guide vanes are produced from a first material, and wherein at least one of the first fastening ring and the second fastening ring is produced from a second material which is different from the first material.

11. An exhaust gas turbocharger, comprising a radial turbine with a nozzle ring as claimed in claim 1.

12. A method for producing a nozzle ring with a plurality of guide vanes which are arranged between a first annular plate-like fastening ring and a second annular plate-like fastening ring arranged coaxially and axially spaced apart, the method comprising:

providing, on one end face of the guide vanes, pins for arranging each guide vane in holes of the first fastening ring;

providing openings in the second fastening ring into which positioning aids of the guide vanes are inserted; and providing the guide vanes to the two fastening rings in a materially bonding, frictionally locking, or form-fitting manner, wherein the openings are matched in size and shape to the positioning aids and correspond in contour to the positioning aids, imposing a permanently fixed angular position on the guide vanes by the interaction between the positioning aids and the openings in the second fastening ring.

13. The method as claimed in claim 12, wherein the guide vanes are configured to rotate around the pin in the hole and are aligned with the openings in the second fastening ring.

14. The method as claimed in claim 12, wherein the positioning aids of the guide vanes are first introduced into the openings in the second fastening ring, and the pins are then introduced into the holes in the first fastening ring.

15. The method as claimed in claim 12, wherein the positioning aids of the guide vanes on the end face, which are introduced into the openings in the second fastening ring, comprise at least one projection, and this projection is introduced into the openings in the second fastening ring, wherein the end face provides a stop for the second fastening ring, and the guide vanes are introduced into the openings in the second fastening ring as far as the stop.

16. The method as claimed in claim 12, wherein the two fastening rings are positioned in relation to each other through a spacer for the materially bonding connection.

17. A nozzle ring assembly, comprising:

a first annular plate-like fastening ring defining a number of holes;

a second annular plate-like fastening ring arranged coaxially with and rotationally fixed with respect to the first fastening ring, the second fastening ring defining a number of openings; and a number of vanes arranged between the first and second fastening rings, each vane including a first end face having a pin extending axially therefrom for connection with the first ring and a second end face opposite the first end face for connection with the second fastening ring;

wherein the pin of each vane is received within one of the number of holes of the first fastening ring and a portion of each vane at the second end face is received within one of the number of openings of the second fastening ring, and the number of openings are shaped to correspond to the respective portion of each vane at the second end face and to prevent rotation of the vane relative to the first and second fastening rings.

18. The nozzle ring assembly of claim 17, wherein the pin of each vane includes a radially outer surface that corresponds with at least a portion of a radially outer surface of a body of the respective vane.

19. The nozzle ring assembly of claim 17, further comprising a third fastening ring defining a number of openings for receiving the portion of each vane at the second end face, the third fastening ring being selectively interchangeable with the second fastening ring.

20. The nozzle ring assembly of claim 19, wherein the number of openings of the second fastening ring are shaped to correspond to the respective portion of each vane at the second end face to prevent rotation of the vane from a first angular position relative to the first and second fastening rings, and wherein the number of openings of the third fastening ring are shaped to correspond to the respective portion of each vane at the second end face to prevent rotation of the vane from a second angular position relative to the first and second fastening rings, the second angular position being different than the first angular position.

* * * * *